US008674889B2

(12) United States Patent
Bengtsson et al.

(10) Patent No.: US 8,674,889 B2
(45) Date of Patent: Mar. 18, 2014

(54) TUNABLE ANTENNA ARRANGEMENT

(75) Inventors: Erik Bengtsson, Eslov (SE); Richard Breiter, Fredriksberg (DE)

(73) Assignee: Nokia Corporation, Espoo (FI)

( * ) Notice: Subject to any disclaimer, the term of this patent is extended or adjusted under 35 U.S.C. 154(b) by 478 days.

(21) Appl. No.: 12/999,454

(22) PCT Filed: Jun. 23, 2008

(86) PCT No.: PCT/EP2008/057977

§ 371 (c)(1),
(2), (4) Date: Feb. 1, 2011

(87) PCT Pub. No.: WO2009/155966

PCT Pub. Date: Dec. 30, 2009

(65) Prior Publication Data

US 2011/0148723 A1 Jun. 23, 2011

(51) Int. Cl.
*H01Q 11/04* (2006.01)

(52) U.S. Cl.
USPC ..... 343/745; 343/702; 343/876

(58) Field of Classification Search
USPC ..... 343/700, 702, 745, 860, 861, 876
See application file for complete search history.

(56) References Cited

U.S. PATENT DOCUMENTS

| | | | | |
|---|---|---|---|---|
| 3,818,480 | A * | 6/1974 | West | 342/435 |
| 3,909,830 | A * | 9/1975 | Campbell | 343/703 |
| 6,300,909 | B1 | 10/2001 | Tsubaki et al. | 343/700 MS |
| 7,215,283 | B2 * | 5/2007 | Boyle | 343/700 MS |
| 7,777,688 | B2 * | 8/2010 | Tani et al. | 343/852 |
| 7,928,914 | B2 * | 4/2011 | Bit-Babik et al. | 343/702 |
| 2003/0174092 | A1 | 9/2003 | Sullivan et al. | 343/702 |
| 2004/0075614 | A1 | 4/2004 | Dakeya et al. | 343/745 |
| 2005/0231439 | A1 | 10/2005 | Suwa et al. | 343/876 |
| 2011/0128200 | A1 * | 6/2011 | Hossain et al. | 343/745 |
| 2012/0007785 | A1 * | 1/2012 | Amari et al. | 343/722 |

FOREIGN PATENT DOCUMENTS

| | | | |
|---|---|---|---|
| EP | 1 729 413 | A1 | 12/2006 |
| EP | 1 753 079 | A1 | 2/2007 |
| JP | 02 236211 | A2 | 9/1990 |
| JP | 9-307344 | | 11/1997 |
| WO | WO 03/065499 | A2 | 8/2003 |
| WO | WO 03/096474 | A1 | 11/2003 |
| WO | WO 2007/096693 | A1 | 8/2007 |
| WO | WO 2008/013021 | A1 | 1/2008 |

OTHER PUBLICATIONS

Novak, R., "Effectively Control Antenna Access in Multi-Band Mobile Handsets", May 29, 2007, www.eetimes.com, 5 pgs.
Lee, J., et al., "A Low-Loss Single-Pole Six-Throw Switch Based on Compact RF MEMS Switches", © 2005 IEEE, pp. 3335-3344.

* cited by examiner

*Primary Examiner* — Tho G Phan
(74) *Attorney, Agent, or Firm* — Harrington & Smith

(57) ABSTRACT

An antenna arrangement including an antenna; a first variable impedance circuit connected between ground and a first point of the antenna; and a second variable impedance circuit connected between ground and a second point of the antenna and a connection from a third point of the antenna to ground wherein; the first point of the antenna and the second point of the antenna are separated along the length of the antenna and the impedance of the first variable impedance circuit and the second variable impedance circuit control the resonant frequency of the antenna arrangement.

20 Claims, 5 Drawing Sheets

TUNABLE ANTENNA ARRANGEMENT

FIELD OF THE INVENTION

Embodiments of the present invention relate to an antenna arrangement. In particular, they relate to an antenna arrangement for a radio transceiver device.

BACKGROUND TO THE INVENTION

In recent years there has been a trend of decreasing the volume of antenna arrangements in devices such as radio transceiver devices. It is important that while the volume of the antenna arrangement is decreased the antenna arrangement has an operational bandwidth which is wide enough to enable the antenna arrangement to operate efficiently. Efficient operation occurs when the insertion loss of the antenna arrangement is better than an operational threshold such as −6 dB.

BRIEF DESCRIPTION OF VARIOUS EMBODIMENTS OF THE INVENTION

According to various, but not necessarily all, embodiments of the invention there is provided an antenna arrangement comprising: an antenna; a first variable impedance circuit connected between ground and a first point of the antenna; and a second variable impedance circuit connected between ground and a second point of the antenna; and a connection from a third point of the antenna element to ground wherein; the first point of the antenna and the second point of the antenna are separated along the length of the antenna and the impedance of the first variable impedance circuit and the second variable impedance circuit control the resonant frequency of the antenna arrangement.

This provides the advantage that the overall impedance of the antenna arrangement and therefore the electrical length is dependent upon the combined impedance of the two variable impedance circuits. As the two variable impedance circuits are connected to different points of the antenna the overall impedance of the antenna arrangement is not limited by either one of the variable impedance circuits or by the impedance of portions of the antenna itself.

This enables a greater range of impedances to be achieved. In particular it enables a greater range of impedances to be achieved than can be achieved with a single variable impedance circuit. Consequently this enables a greater range of resonant frequencies. By varying the impedance of the appropriate circuits the resonant frequencies of the antenna arrangement can be controlled so as to increase the operational bandwidth of the antenna arrangement. As the increase in operational bandwidth is achieved by the use of additional circuitry this does not substantially increase the volume of the antenna arrangement.

The second variable impedance circuit may be connected to the feed of the antenna.

The first variable impedance circuit may comprise a tuning circuit and a switching mechanism for connecting/disconnecting the tuning circuit to the antenna. The switching mechanism may have a plurality of configurations wherein different configurations of the switching mechanism connect a different tuning circuit to the antenna so that the antenna arrangement has a different resonant frequency for different configurations of the switching mechanism.

Alternatively the first variable impedance circuit may comprise a continuously variable tuning circuit.

The second variable impedance circuit may comprise a tuning circuit and a switching mechanism for connecting/disconnecting the tuning circuit to the antenna. The switching mechanism may have a plurality of configurations wherein different configurations of the switching mechanism connect a different tuning circuit to the antenna so that the antenna arrangement has a different resonant frequency for different configurations of the switching element. The switching mechanism of the second variable impedance circuit may have a configuration in which the tuning circuit is disconnected from the antenna.

Alternatively the second variable impedance circuit may comprise a continuously variable tuning circuit.

The variable impedance circuits may be connected to a ground plane.

The antenna may be an F antenna or a loop antenna.

According to various, but not necessarily all, embodiments of the invention there is provided a method comprising: controlling the impedance of a first variable impedance circuit connected between ground and a first point of an antenna; controlling the impedance of a second variable impedance circuit connected between ground and a second point of the antenna; providing a connection from a third point of the antenna to ground wherein; the first point of the antenna and the second point of the antenna are separated along the length of the antenna and the impedance of the first variable impedance circuit and the second variable impedance circuit control the resonant frequency of the antenna.

According to various, but not necessarily all, embodiments of the invention there is also provided an antenna arrangement comprising: an antenna having a connection from a first point of the antenna to ground, a feed connection and a connection from a third point of the antenna to ground wherein; a first variable impedance circuit connected in series between the ground and the first point of the antenna; and a second variable impedance circuit connected to the feed connection in parallel with the first variable impedance circuit.

According to various, but not necessarily all, embodiments of the invention there is also provided a module comprising an antenna as described above.

According to various, but not necessarily all, embodiments of the invention there is also provided a portable electronic device comprising an antenna as described above.

The device may be for wireless communication.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
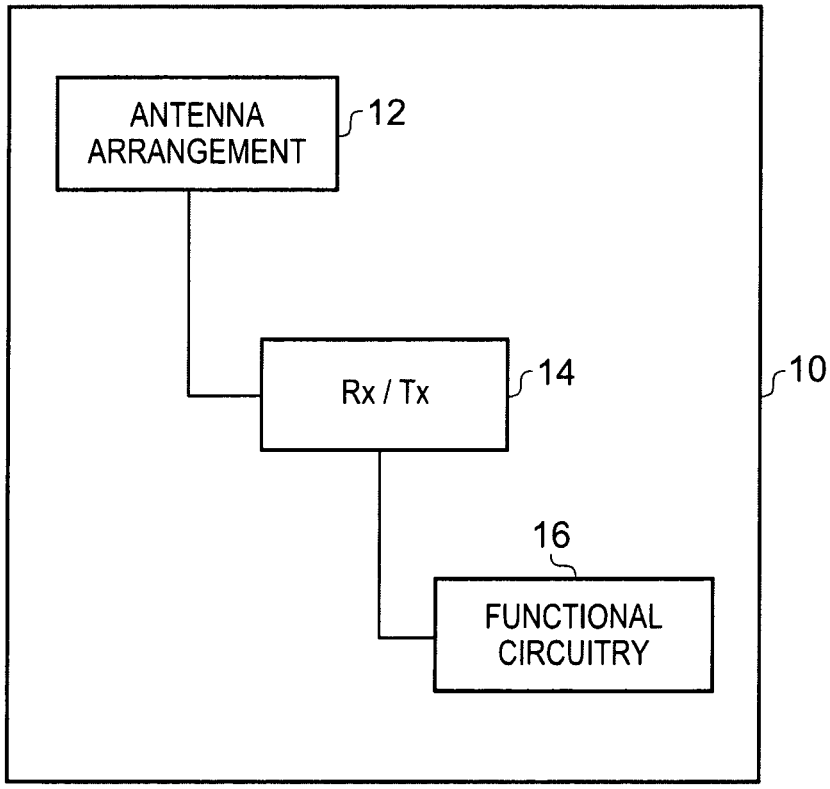
FIG. 1 is a schematic diagram of a radio transceiver device comprising an antenna arrangement.

The Figures illustrate an antenna arrangement 12 comprising: an antenna 22; a first variable impedance circuit 30 connected between ground and a first point 23 of the antenna 22; and a second variable impedance circuit 34 connected between ground and a second point 25 of the antenna 22; and a connection 62 from a third point 61 of the antenna 22 to ground wherein; the first point 23 of the antenna 22 and the second point 25 of the antenna 22 are separated along the length of the antenna 22 and the impedance of the first variable impedance circuit 30 and the second variable impedance circuit 34 control the resonant frequency of the antenna arrangement 12.

FIG. 1 schematically illustrates an apparatus 10 comprising an antenna arrangement 12 according to embodiments of the invention. The apparatus 10 may be any portable device and may be, for example, a mobile cellular telephone, a personal digital assistant (PDA), a laptop computer, a palm top computer, a portable WLAN or WiFi device, or module for such devices. As used here, 'module' refers to a unit or apparatus that excludes certain parts/components that would be added by an end manufacturer or a user.

The apparatus 10 comprises an antenna arrangement 12, a transceiver 14 and functional circuitry 16. In embodiments where the apparatus 10 is a device such as a mobile cellular telephone, the functional circuitry 16 comprises a processor, a memory and input/output devices such as a microphone, a loudspeaker, a display and a user input device such as a keypad.

The transceiver 14 is connected to the functional circuitry 16 and the antenna arrangement 12. The functional circuitry 16 is arranged to provide data to the transceiver 14. The transceiver 14 is arranged to encode the data and provide it to the antenna arrangement 12 for transmission. The antenna arrangement 12 is arranged to transmit the encoded data as a radio signal.

The antenna arrangement 12 is also arranged to receive a radio signal. The antenna arrangement 12 then provides the received radio signal to the transceiver 14 which decodes the radio signal into data and provides the data to the functional circuitry 16.

The antenna arrangement 12 may be arranged to operate in a plurality of different operational radio frequency bands and via a plurality of different protocols. For example, the different frequency bands and protocols may include (but are not limited to) AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz). The electrical length of the antenna arrangement may be tuned in order to achieve these frequencies and protocols.

Figure 2:
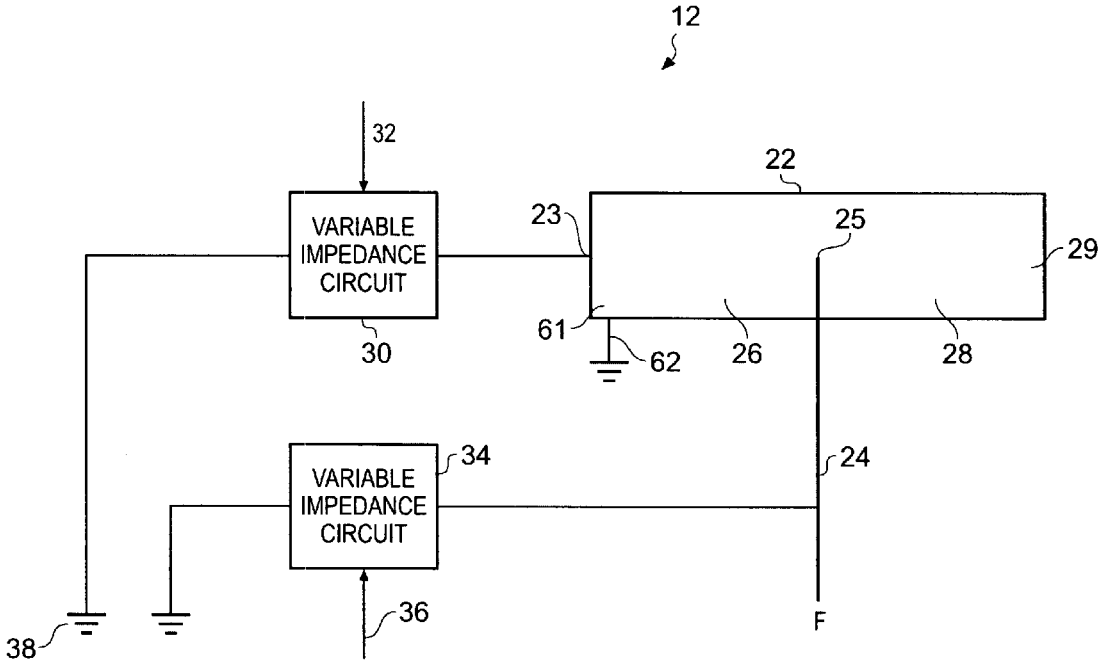
FIG. 2 is a schematic diagram of an antenna arrangement according to a first embodiment of the invention.

FIG. 2 is a schematic illustration of an antenna arrangement 12 according to an embodiment of the invention. The antenna arrangement 12 comprises an antenna 22, a first variable impedance circuit 30 and a second variable impedance circuit 34.

In the embodiment illustrated in FIG. 2 the antenna 22 is a PIFA antenna, in other embodiments the antenna element may be any F antenna having a feed point and a connection to ground or a loop antenna.

In the embodiment illustrated the antenna 22 comprises a single radiative element. In other embodiments of the invention the antenna 22 may comprise a plurality of radiative elements which may be galvanically attached to each other or electromagnetically coupled together.

In the embodiment illustrated in FIG. 2 the antenna 22 is connected to ground 38 via a first point 23. This point 23 is also connected to a variable impedance circuit 30 and may be considered to be a tuning connection. The antenna is also connected to a feed 24 via a feed point 25. The antenna 22 comprises a first portion 26 between the first point 23 and the feed point 25 and a second portion 28 between the feed point 25 and the free end 29 of the antenna 22.

In the illustrated embodiment the antenna 22 also comprises a third connection 62 from a third point 61 of the antenna 22 to ground. In the illustrated embodiment the third point is in the first portion 26 of the antenna element between the first point 23 and the feed point 25. In other embodiments the third point may be positioned in a different portion of the antenna 22.

The first variable impedance circuit 30 is connected between ground and the first point 23 of the antenna 22. The first variable impedance circuit 30 may be considered to be in series with the first portion 26 of the antenna 22. The first control signal 32 controls the impedance of the first variable impedance circuit 30. The electrical length of the antenna arrangement 12 depends upon the impedance of the first variable impedance circuit 30. The electrical length of the antenna arrangement 12 can be controlled by controlling the impedance of the first variable impedance circuit 30. This enables the antenna arrangement 12 to be tuned to have a particular electrical length and therefore resonate at a particular frequency.

Although the impedance of the first variable impedance circuit 30 can be controlled it is connected to the first portion 26 of the antenna 22 which has a fixed impedance. The impedance of the first portion 26 therefore imposes a limit on the impedance of the section of the antenna arrangement 12 between the ground 38 and the feed point 25 which consequently imposes a limit on the range of resonant frequencies that can be achieved by the antenna arrangement 12.

A second variable impedance circuit 34 is connected to the feed point 25 of the antenna 22. The feed point 25 is separated from the first point 23 along the length of the antenna 22 by the first portion 26 of the antenna 22. The second variable impedance circuit 34 may be considered to be connected in parallel with the first impedance circuit 30 and the first portion 26 of the antenna 22. The impedance of the second variable impedance circuit 34 is controlled by the second control signal 36.

In the illustrated embodiment the second variable impedance circuit 34 is connected in parallel to the feed connection 24. In other embodiments the second variable impedance circuit 34 may be connected between the transceiver 14 which is providing the feed signal and the feed point 25, that is, the second variable impedance circuit may be in series with the feed connection. In other embodiments the second variable impedance circuit 34 may be connected both in parallel to the feed connection 24 and also connected in series between the transceiver 14 and the feed point 25. For example the second variable impedance circuit 34 may comprise two portions a first portion which is connected in parallel to the feed and a second portion which is connected in series.

The electrical length of the antenna arrangement 12 also depends upon the impedance of the second variable impedance circuit 34. The electrical length of the antenna arrangement 12 can be controlled by controlling the impedance of the first variable impedance circuit 30 and/or the second variable impedance circuit 34.

As the second variable impedance circuit 34 is connected to a different point of the antenna element the first portion 26 of the antenna 22 the impedance of the first portion 26 does not impose a limit on the impedance of the section of the circuit. This means that a greater range of impedances can be achieved by connecting the second variable impedance circuit 34 to the antenna 22 and consequently enables a greater range of operable resonant frequencies to be achieved by the antenna arrangement 12.

By selecting appropriate values of the impedances for the variable impedance circuits 30, 34 the antenna arrangement 12 can be tuned to resonate at a plurality of different frequencies and so increase the operational bandwidth of the antenna arrangement 12. The operational bandwidth of the antenna arrangement 12 is the range of frequencies over which the antenna arrangement 12 can operate efficiently. Efficient operation occurs when the insertion loss of the antenna arrangement is better than an operational threshold such as −6 dB.

Figure 3:
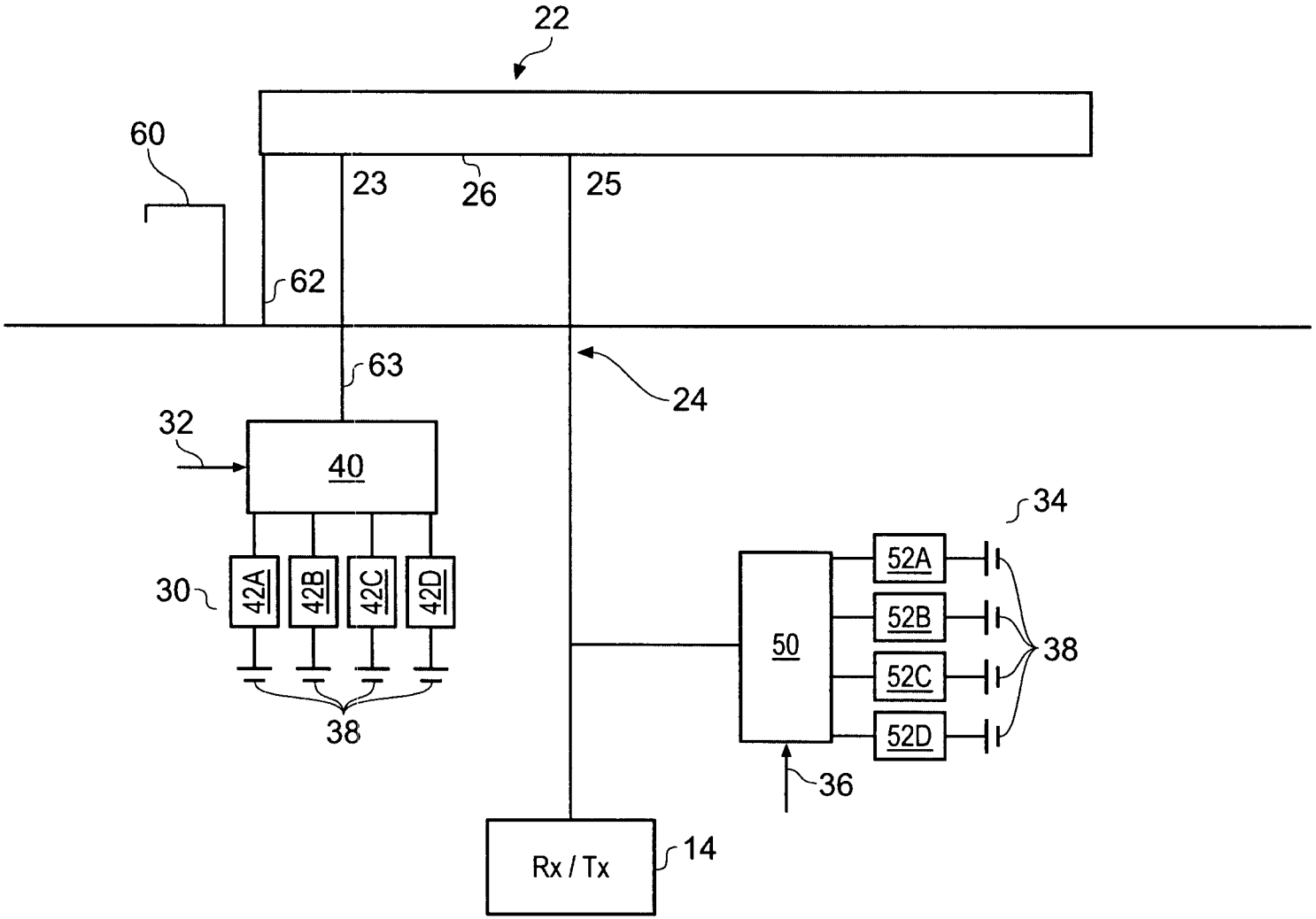
FIG. 3 is a schematic diagram of an antenna arrangement according to a second embodiment of the invention.

FIG. 3 illustrates an antenna arrangement 12 according to a second embodiment of the invention. The antenna arrangement 12 of this embodiment of the invention also comprises an antenna 22, a first variable impedance circuit 32 and a second variable impedance circuit 34 connected in the same manner as the embodiment illustrated in FIG. 2.

In this embodiment the antenna 22 is a PIFA. The PIFA 22 is configured to be operable in two different frequency bands. The antenna arrangement 12 comprises a parasitic element 60 which, in this embodiment, couples to the antenna 22 in the high band mode of operation. In other embodiments the parasitic element 60 may couple to the antenna 22 in the low band mode of operation or there may be no parasitic element 60.

The PIFA has three connections 62, 63 and 24. The first connection 62 is a connection direct to ground. The second connection 63 is a tuning connection. In the illustrated embodiment the tuning connection 63 comprises a first variable impedance circuit 30 which is connected between ground and a first point 23 of the antenna 22. The third connection 24 is a feed connection and is connected to a second point 25 of the antenna 22. The second point 25 is separated from the first point 23 by the first portion 26 of the antenna 22.

The first variable impedance circuit 30 is connected to ground and comprises a switch mechanism 40 which is configured to connect and disconnect a plurality of tuning circuits 42 to the antenna 22. In the particular embodiment illustrated in FIG. 3 the switch mechanism is an SP4T (single pole 4 throw) switch and enables any one of four different tuning circuits 42 to be connected to the antenna 22. The electrical length and therefore the resonant frequency of the antenna arrangement 12 is dependent upon which of the four tuning circuits 42 is connected to the antenna 22. The first control signal 32 controls the impedance of the first variable impedance circuit 30 by controlling the configuration of the switch mechanism 40.

The first variable impedance circuit 30 is connected to the PIFA 22 so that the first variable impedance circuit 30 is in series with a first portion 26 of the PIFA 22.

The second variable impedance circuit 34 also comprises a switch mechanism 50 which is also configured to connect and disconnect a plurality of tuning circuits 52. In the particular embodiment illustrated in FIG. 3 the switch mechanism 50 connected to the second variable impedance circuit 34 is also an SP4T (single pole 4 throw) switch and also enables any of four different tuning circuits 52 to be connected to the antenna 22. The control signal 36 controls the impedance of the second variable impedance circuit 34 by controlling the configuration of the switch mechanism 50.

In the illustrated embodiment the switch mechanism 50 of the second variable impedance circuit 34 has the same number of switch positions as the switch mechanism 40 of the first variable impedance circuit 30. In other embodiments the two switch mechanisms 40, 50 may have different numbers of switch positions, for example the first switch mechanism 40 could have four switch positions while the second switch mechanism 50 only has two.

The second variable impedance circuit 34 is connected to the feed point 25 of the antenna 22 and may be considered to be connected in parallel with the first variable impedance circuit 30 and the first portion 26 of the PIFA.

The second embodiment of the invention works in the same way as the first embodiment. As the variable impedance circuits 30, 34 are connected to different points of the antenna 22 the overall impedance of the antenna arrangement 12 is not limited by the impedance of either of the variable impedance circuits 30, 34 or of any portion of the antenna 22. By selecting appropriate impedance values for the tuning circuits a plurality of different resonant frequencies can be achieved which consequently increases the operational bandwidth of the antenna arrangement 12.

Figure 4:
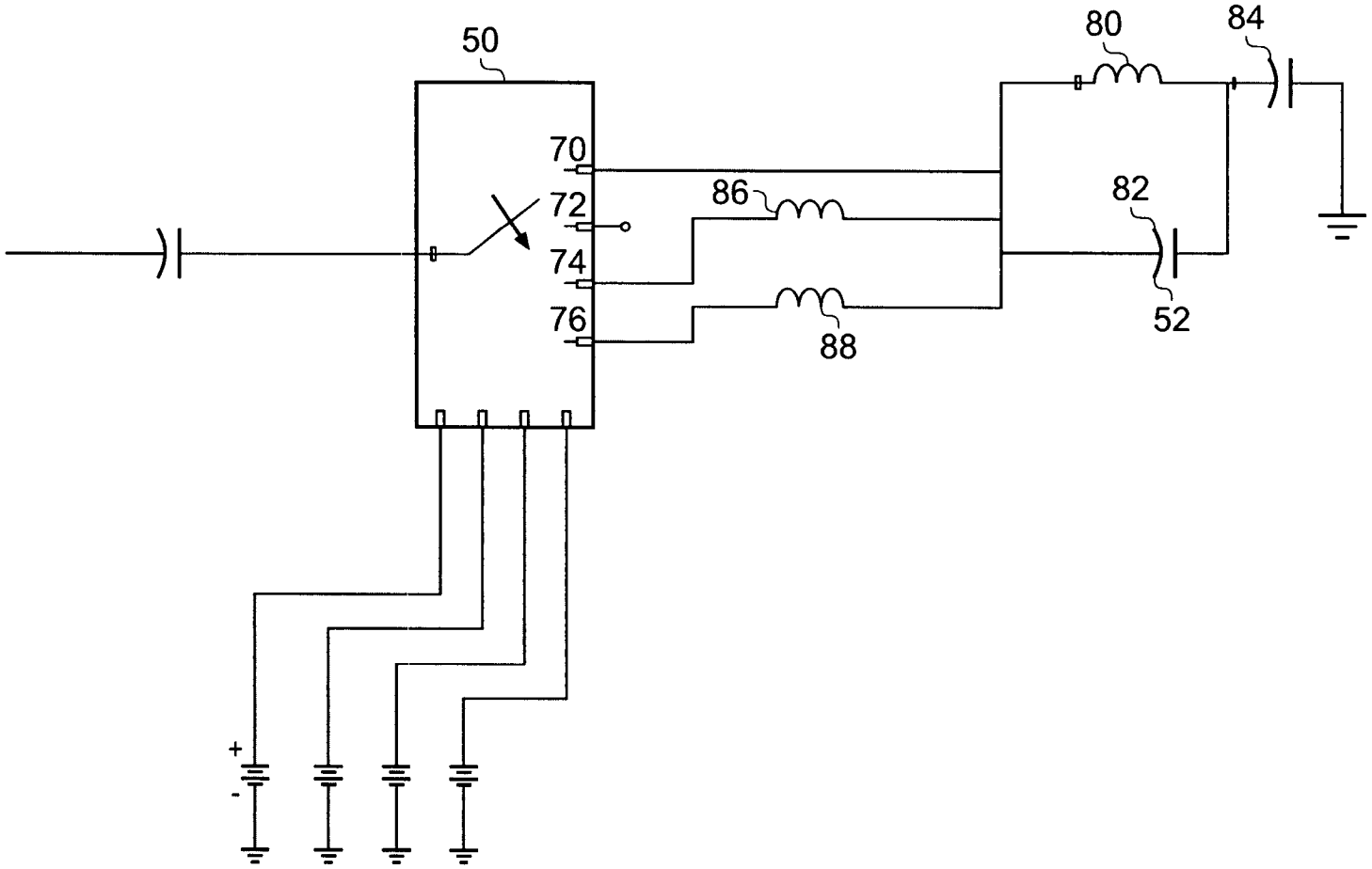
FIG. 4 is a circuit diagram of a variable impedance circuit according to an embodiment of the invention.

FIG. 4 is a circuit diagram of a variable impedance circuit which may be used as the second variable impedance circuit 34 within embodiments of the invention such as the embodiment illustrated in FIG. 3.

In the particular embodiment illustrated in FIG. 4 the switching mechanism 50 is an SP4T switch. Each of the four positions of the switching mechanism 50 connects to a different tuning circuit 52. The tuning circuit 52 is connected to ground 38.

When the switch is configured in the first position 70 the tuning circuit 52, which comprises a first inductor 80 in parallel with a first capacitor 82, is connected to the antenna 22. A second capacitor 84 is connected between ground and the tuning circuit 52. In this specific embodiment the inductor has an inductance of 5.5 nH, the first capacitor has a capacitance of 7 pF and the second capacitor has a capacitance of 100 pF. The second capacitor 84 acts as a DC blocking component.

When the switch is configured in the second position 72 the tuning circuit 52 is disconnected from the antenna 22.

When the switch is configured in the third position 74 the tuning circuit 52 and capacitor 84 is connected to the antenna 22 in series with a second inductor 86. In this specific embodiment the second inductor 86 has an inductance of 1 nH.

When the switch is configured in the fourth position 76 the tuning circuit 52 and capacitor 84 is connected to the antenna 22 in series with a third inductor 88. In this specific embodiment the third inductor 88 has an inductance of 6 nH.

Each of the switch positions therefore connects a different circuit having a different impedance to the antenna 22. Therefore each position of the switch mechanism corresponds to a different electrical length of the antenna arrangement 12 and therefore enables the antenna 22 to resonate at a different resonant frequency.

The values and arrangement of the components of the variable inductance circuit given above are specific to the particular embodiment described. It is to be appreciated that in other embodiments the values of the components of the tuning circuits may be selected so as to enable the antenna arrangement 12 to resonate at a particular frequency and so may have other values. Also the components may be arranged in a different configuration or different components such as microstrip lines, strip lines and delay lines may be used.

Figure 5:
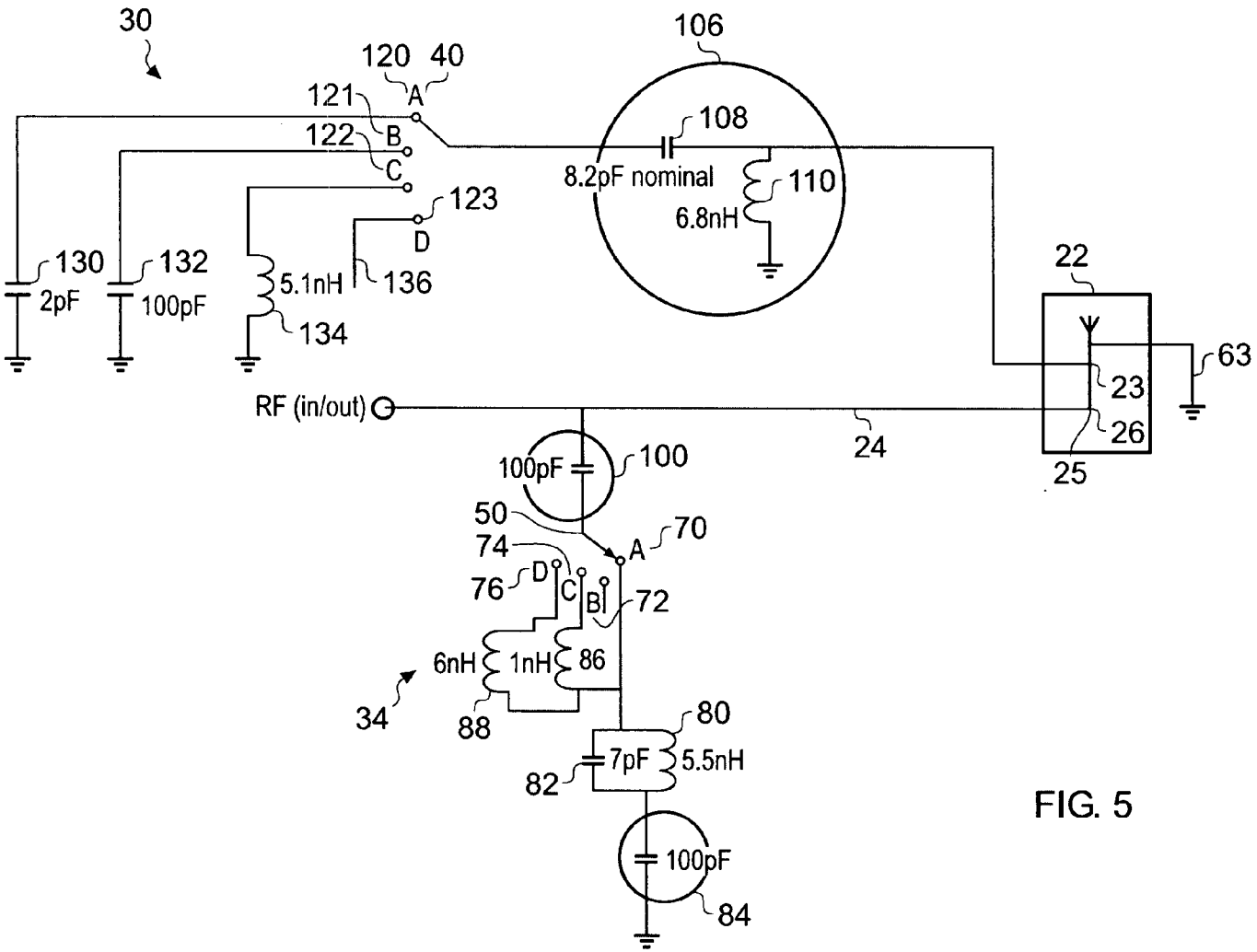
FIG. 5 is a circuit diagram of an antenna arrangement according to an embodiment of the invention.

FIG. 5 is a circuit diagram of an embodiment of the invention. This embodiment comprises a second variable impedance circuit 34 as illustrated in FIG. 4 connected to an antenna 22. The switching mechanism 50 and tuning circuit 52 are as described above with reference to FIG. 4 The second variable impedance circuit 34 is connected to the feed 24. An additional capacitor 100 is connected between the second variable impedance circuit 34 and the feed 24. The additional capacitor 100 acts as a DC blocking component. The capacitance of the additional capacitor 100 in this specific embodiment is 100 pF.

In the embodiment illustrated in FIG. 5 the first switching mechanism 40 is also an SP4T switch having four switch positions. When the switch mechanism 40 is configured in the first position 120 the capacitor 130 is connected to the antenna 22. In the illustrated embodiment the capacitor has a capacitance of 2 pF. The connection of the capacitor 130 to the antenna 22 increases the electrical length of the antenna arrangement 12 and consequently lowers the resonant frequency of the antenna arrangement 12.

When the switch mechanism 40 is configured in the second position 121 the capacitor 132 is connected to the antenna 22. In the illustrated embodiment the capacitor 132 has a capacitance of 100 pF and at radio frequencies is feed through so that this connection acts as a short circuit. In some embodiments the capacitor 132 may be omitted and so that the antenna 22 is connected directly to ground.

When the switch mechanism 40 is configured in the third position 122 the inductor 134 is connected to the antenna 22. In the illustrated embodiment the inductor 134 has an inductance of 5.1 nH. The connection of the inductor 134 to the antenna 22 decreases the electrical length of the antenna arrangement 12 and consequently increases the resonant frequency of the antenna arrangement 12.

When the switch mechanism 40 is configured in the fourth position 123 the antenna element is connected to an open circuit 136.

An electrostatic discharge (ESD) filter 106 is connected between the switching mechanism 40 and the antenna 22. The ESD filter reduces ESD noise in the antenna arrangement 12. In this embodiment the ESD filter 106 comprises a capacitor 108 with a capacitance of 8.2 pF and an inductor 110 with an inductance of 6.8 nH connected in shunt.

The switching mechanisms 40 and 50 may be semiconductor switches, for example field effect transistors (FETs) or bipolar junction transistors (BJTs), or MEMs (micro electromechanical) switches, or mechanical switches, or any kind of switching device.

Although embodiments of the present invention have been described in the preceding paragraphs with reference to various examples, it should be appreciated that modifications to the examples given can be made without departing from the scope of the invention as claimed. For example the switch mechanisms used in the above described embodiments each have four states. It is to be appreciated that switches having any number of states may be used. Alternatively the variable impedance circuits may be continuously variable tuning circuits.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An antenna arrangement comprising:

an antenna;

a first variable impedance circuit connected between ground and a first point of the antenna; and a second variable impedance circuit connected between ground and a second point of the antenna and a connection from a third point of the antenna to ground wherein;

the first point of the antenna and the second point of the antenna are separated along the length of the antenna and the impedance of the first variable impedance circuit and the second variable impedance circuit control the resonant frequency of the antenna arrangement.

2. An antenna arrangement as claimed in claim 1 wherein the second variable impedance circuit is connected to the feed of the antenna.

3. An antenna arrangement as claimed in claim 1 wherein the first variable impedance circuit comprises a tuning circuit and a switching mechanism for connecting/disconnecting the tuning circuit to the antenna.

4. An antenna arrangement as claimed in claim 3 wherein the switching mechanism of the first variable impedance circuit has a plurality of configurations wherein different configurations of the switching mechanism connect a different tuning circuit to the antenna so that the antenna arrangement has a different resonant frequency for different configurations of the switching mechanism.

5. An antenna arrangement as claimed in claim 1 wherein the first variable impedance circuit comprises a continuously variable tuning circuit.

6. An antenna arrangement as claimed in claim 1 wherein the second variable impedance circuit comprises a tuning circuit and a switching mechanism for connecting/disconnecting the tuning circuit to the antenna.

7. An antenna arrangement as claimed in claim 6 wherein the switching mechanism of the second variable impedance circuit has a plurality of configurations wherein different configurations of the switching mechanism connect a different tuning circuit to the antenna so that the antenna arrangement has a different resonant frequency for different configurations of the switching mechanism.

8. An antenna arrangement as claimed in claim 7 wherein the switching mechanism of the second variable impedance circuit has a configuration in which the tuning circuit is disconnected from the antenna.

9. An antenna arrangement as claimed in claim 1 wherein the second variable impedance circuit comprises a continuously variable tuning circuit.

10. An antenna arrangement as claimed in claim 1 wherein the variable impedance circuits are connected to a ground plane.

11. An antenna arrangement as claimed in claim 1 wherein the antenna is an F antenna.

12. An antenna arrangement as claimed in claim 1 wherein the antenna is a loop antenna.

13. A module comprising an antenna as claimed in claim 1.

14. A portable electronic device comprising an antenna as claimed in claim 1.

15. An antenna arrangement as claimed in claim 1 wherein the antenna comprises a single radiative element.

16. A method comprising:

controlling the impedance of a first variable impedance circuit connected between ground and a first point of an antenna;

controlling the impedance of a second variable impedance circuit connected between ground and a second point of the antenna providing a connection from a third point of the antenna to ground wherein;

the first point of the antenna and the second point of the antenna are separated along the length of the antenna and the impedance of the first variable impedance circuit and the second variable impedance circuit control the resonant frequency of an antenna arrangement comprising the antenna.

17. A method as claimed in claim 16 wherein the impedance of the first variable impedance circuit is controlled by controlling the configuration of a switch mechanism to connect/disconnect a tuning circuit to the antenna.

18. A method as claimed in claim 16 wherein the impedance of the first variable impedance circuit is controlled by varying the impedance of a continuously variable tuning circuit.

19. An antenna arrangement comprising:

an antenna having a connection from a first point of the antenna to ground, a feed connection and a connection from a third point of the antenna to ground wherein;

a first variable impedance circuit connected in series between the ground and the first point of the antenna; and a second variable impedance circuit connected to the feed connection in parallel with the first variable impedance circuit.

20. An antenna arrangement as claimed in claim 19 wherein the antenna comprises a first portion between the first point and the feed connection and the first portion of the antenna has an inherent impedance.

* * * * *